United States Patent [19]

Rabuse

[11] Patent Number: 4,762,341

[45] Date of Patent: Aug. 9, 1988

[54] BOOKLET COVER

[75] Inventor: George R. Rabuse, Sunfish Lake, Minn.

[73] Assignee: Minnesota Mining and Manufacturing Company, Saint Paul, Minn.

[21] Appl. No.: 719,698

[22] Filed: Apr. 4, 1985

[51] Int. Cl.[4] ..... B42D 1/10; B42D 3/00

[52] U.S. Cl. ..... 281/29; 281/212; 281/23; 281/35; 412/8; 412/34; 412/901

[58] Field of Search ..... 281/4, 19 R, 29, 20, 281/34, 21 R, 23, 35, 36, 45; 412/19, 21, 24, 30, 901, 8, 34; 156/212, 216, 289, 908; 428/352, 211; 283/64; 402/79; 40/359; 312/184

[56] References Cited

U.S. PATENT DOCUMENTS

| | | | |
|---|---|---|---|
| 848,680 | 4/1907 | Nelson . | |
| 925,172 | 6/1909 | Hafely | 281/23 |
| 1,765,194 | 6/1930 | Von Auw . | |
| 1,913,969 | 6/1933 | Wood . | |
| 2,014,305 | 9/1935 | Alger | 281/29 |
| 2,039,752 | 5/1936 | Thomas | 402/79 |
| 2,510,263 | 6/1950 | Stein | 281/21 R |
| 3,190,678 | 6/1965 | Peterson et al. | 281/29 |
| 3,749,423 | 7/1973 | Abildgaard et al. | 281/21 |
| 3,834,739 | 9/1974 | Abildgaard et al. | 281/21 |
| 3,863,828 | 2/1975 | King | 40/359 X |
| 4,284,227 | 8/1981 | Corey | 229/DIG. 4 X |
| 4,354,890 | 10/1982 | Maffey | 281/21 R |
| 4,477,013 | 10/1984 | Herrin | 40/359 X |
| 4,511,298 | 4/1985 | Jones | 412/33 |
| 4,518,296 | 5/1985 | Pearson et al. | 412/8 X |
| 4,558,888 | 12/1985 | Hanson et al. | 281/23 |
| 4,673,324 | 6/1987 | Hanson et al. | 412/901 X |

FOREIGN PATENT DOCUMENTS

| | | | |
|---|---|---|---|
| 1423105 | 11/1964 | France . | |
| 6703833 | 10/1967 | Netherlands | 281/45 |
| 1544387 | 4/1979 | United Kingdom | 283/37 |

*Primary Examiner*—Howard N. Goldberg
*Assistant Examiner*—Taylor J. Ross
*Attorney, Agent, or Firm*—Donald M. Sell; John C. Barnes

[57] ABSTRACT

A cover for protecting and supporting a plurality of sheets bound together with a pressure-sensitive adhesive tape and bound to the cover by the tape. The cover has a binding area and a protective coating in that area where the binding tape has an adhesion force of between 200 and 700 grams per 1.27 cm width of tape according to a standard adhesion peel test. The coating may be an actual coating of low adhesion material, a film, a coated plastic film, or the cover material. The cover may include a sheet folded centrally, a truncated cover to afford attachment of a separate cover sheet, or the cover may be formed to cover only the front or back of the documents to be bound thereon.

15 Claims, 1 Drawing Sheet

BOOKLET COVER

BACKGROUND OF THE INVENTION

1. Field of the Invention

This invention relates to an improvement in a cover for use with bound sheets to form a booklet, and in one aspect to an improved cover construction for use in forming a binding cover for sheets which are bound together with a length of pressure-sensitive adhesive tape.

2. Description of the Prior Art

Paper covers have been used for containing papers as in a file and have been used for binding sheets together. Such covers find utility with various binding systems including the use of pull-out resilient side clips which hold the cover and the marginal edges of the sheets together. Other covers have permanent tangs and eyelets. Some are formed with an accordion fold to bind the sheets together by the metal tangs. Some covers bind the sheets with "ACCO" metal fasteners at one end on the inside of the front or back cover. Other covers have a deposit of hot melt adhesive at the spine to secure pages or signatures in the cover.

All of these covers have described a system where, when the pages are bound together, the pages or sheets are bound in such a way that they cannot lie flat when the cover is open and the pages are being reviewed. This is perhaps less true with the hot melt bindings but the sheets still do not lie flat when the cover is opened.

There are also binders or covers with reinforcing at the folded edge to extend the life of the files and to prevent the same from tearing out along the crease or fold. There is in the prior art, however, no suggestion that a pamphlet or sheet binding cover should have a protective coating on the inner surface of the cover along the central fold line to permit controlled adhesion of the binding tape, wherein a pressure-sensitive adhesive binding tape is used to bind a plurality of sheets together. Such a binding is afforded wherein the sheets are shingled along one edge and the pressure-sensitive adhesive tape is applied to the shingled paper edges along one edge of the tape with the other edge of the tape adhered to the cover adjacent the fold line. A document bound in this manner thus has all of the pager secured to one another by virture of the pressure-sensitive adhesive tape being applied to the edges of the sheets and the bound sheets are secured to the cover by the same adhesive tape being applied to the inside of the back cover.

A cover which is formed only of paper is not suitable. Sometimes it is necessary or desirable to remove the bound pages from the cover. This results because of misalignment of the pages with respect to the cover when binding the same, or, it may be desirable to make changes in the bound pages and it is prudent and economical to save the covers for reuse if possible. When the cover stock is paper the pressure-sensitive adhesive on the binding tape will adhere to the paper stock. Attempts to remove the tape will cause the paper stock to delaminate or tear before the tape adhesive is released or peeled from the paper.

Thus, the present invention is directed at a paper cover stock which is designed such that a binding tape will adhere adequately to the cover, but upon demand, can be peeled from the cover without causing a delamination of the material of the cover stock. Thus, the present invention has as one object the provision of a binding cover which is adapted for use with a tape binding system for binding sheets together and securing the sheets in the cover. The cover of the present invention is so designed that the tape will hold the bound pages in the cover and will restrict displacement under normal use conditions.

SUMMARY OF THE INVENTION

The present invention is directed to a binding cover for use in binding sheets together. The cover is formed such that it will securely retain the bound sheets in place under normal handling conditions but will release them when a peeling force is applied to the tape.

The binding cover of the present invention comprises a sheet of paper cover stock folded along a generally central line as at a score line or mere fold line, and along this line on the inside of the cover is a protective coating which will have sufficient adhesion to the binding tape to secure the pages and yet afford a release of the binding tape without a delamination of the cover, breaking of the tape or adhesive transfer to the coated area upon peeling the binding tape from the cover.

A suitable protective coating must have sufficient adhesion to the tape to permit the bound pages to hang freely from the cover with the tape under a peeling force, as opposed to a shear force. Such peeling force would be normal in a file with the weight of the sheets applying a peel force on the tape. The adhesion must similarly be not so high that the tape will not release, the backing delaminate, the tape break, or the adhesive split, causing a failure of the binding when attempting to remove the bound sheets. The tape should release from the protective coating prior to the tape failing or the adhesive splitting. If the tape fails it is no longer suitable for binding the document in the cover. In such case, the tape must be removed from the sheets and cover stock and the sheets must be rebound, which is troublesome.

The cover of the present invention preferably comprises a paper cover stock formed with a fold line or score line generally centrally thereof with a protective coating along the fold line which will release from the adhesive on the binding tape under a peel force of between 200 and 700 grams as defined by a standard test using a preferred binding tape.

The binding cover of the present invention may have a protective coating in the form of a film which is adhered to the cover to span the center or fold line and extend to the adjacent front and the back covers. Further, a low adhesion protective coating can be applied to the paper stock adjacent the fold line on the front and back covers. Alternatively, the cover may be formed as a composite of paper and film wherein the front cover portion of the binder, which is formed of film, preferably transparent, is laminated to the paper adjacent the fold line and a protective coating is applied along each side of the fold line. Further, the cover may be formed of a plastic material which has the desired adhesion characteristics in relationship to the binding tape.

A preferred embodiment of the cover of the present invention comprises a finished paper cover stock folded along a score line. A protective coating is applied to the cover stock affording an initial adhesion to the finding tape of at least 200 grams per 1.27 cm of width and not to exceed 700 grams per 1.27 cm of width. One coating is a length of polypropylene film adhered to the cover and extending from the score line onto the inner surface of the front and back cover. The polypropylene film applied to the cover's spine adjacent the score line area has an initial adhesion to the binding tape of 430 grams per 1.27 cm of width of tape and on an accelerated test for aging, the binding tape has adhesion to the film of 590 grams per 1.27 cm of tape width.

DESCRIPTION OF THE DRAWING

The present invention will be described in greater detail with reference to the accompanying drawing wherein.

DESCRIPTION OF THE PREFERRED EMBODIMENT

Figure 1:
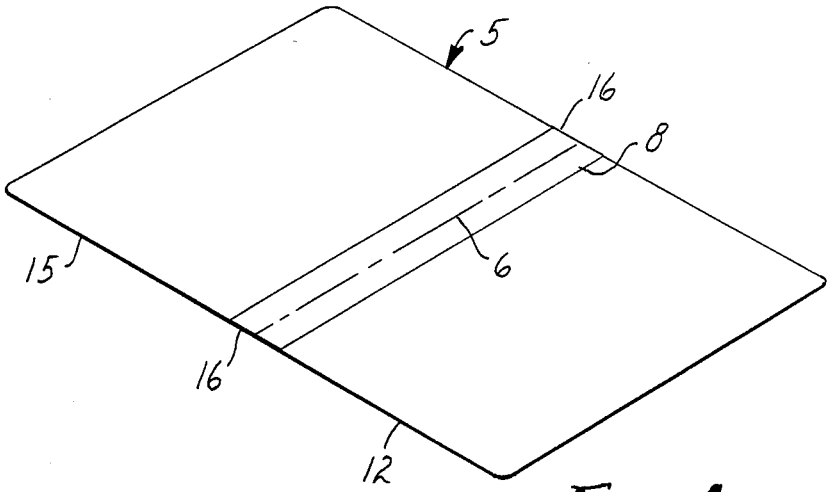
FIG. 1 is a plan view of an opened cover constructed according to the present invention.
Figure 2:
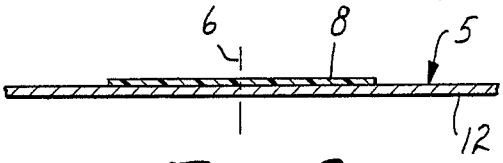
FIG. 2 is a fragmentary transverse sectional view of the cover of FIG. 1.

The present invention provides an improved binding cover for use in making a booklet or brochure for purposes of presentation of a professional looking document, report, or other bound work.

The cover of the present invention is formed preferably of paper cover stock formed as a sheet 5, for the U.S.A. market of preferably about 46.5 cm by 28.9 cm, with a score line or fold line 6 disposed generally centrally and joining the long edges thereof. The sheet 5 of paper cover stock generally has a starch sizing and may have an embossed finish. The cover 5 has a binding area on which a protective coating 8 is applied. The binding area is along the score or fold line 6 on the inside surface of the front and rear cover portions and to either side of the line by about 1.6 cm.

This coated area 8 of the cover provides a prepared cover which will have the desired release characteristic for a pressure-sensitive adhesive binding tape sufficient such that bound sheets are secured in the covers sufficiently to prevent the sheets from coming loose from the covers during ordinary use or storage in a file and the sheets can be removed from the cover without breaking the binding tape, delaminating the cover stock or transferring of the adhesive. Both the ease of removal of the tape from the cover and the secure binding of the sheets for storage are critical factors to the present invention. The desired range for this acceptable adhesion and release limitation is: the adhesion to the binding tape must be measureable between 200 and 700 grams per 1.27 cm (ASTM D 3330-81) for pressure-sensitive adhesive tape identified as "Scotch" brand binding system tape No. C-7888, available from Minnesota Mining and Manufacturing Company of St. Paul, Minn. This range of adhesion permits the bound pages to be removed from a booklet if the bound pages are misaligned with the score line in the cover or it is desirable to make changes in the bound pages and/or to save the covers for reuse after the bound materials are discarded.

The binding system tape comprises a backing of a unified nonwoven fibrous fabric carrying a continuous coating of a pure rubbery copolymer pressure-sensitive adhesive. The backing is very supple and the adhesive is applied to the backing and is 0.076 mm thick. The backing will have a barrier coating to restrict migration of the adhesive through the porous backing. The binding tape had a 180° peel adhesion (ASTM D 3330-81) of 350 grams per 1.27 cm of tape width.

The protective coatings 8 applied in the central area of the cover which will achieve the adhesion desired are formed according to the following examples.

EXAMPLE 1

Jersey 80 pound embossed leatherette finish paper cover stock from James River Corporation, Riegel Division, Milford, N. J. 08848 was coated with an acrylic low adhesion backsize (L.A.B.) material formulated according to U.S. Pat. No. 2,607,711. The cover stock was coated with 5% acrylic low adhesion backsize material using a 0.001 inch (0.025 mm) coating thickness with a hand coater. The sample was then air dried and tested by applying a half inch wide (1.27 cm) piece of "Scotch" brand binding tape No. C-7888 to the coated area and following the test procedures of ASTM D 3330-81, but applying the binding tape directly to the coated area. The initial adhesion strength was 210 grams per 1.27 cm of tape with an accelerated aging over 14 days at 120 degrees F. (about 50° C.) of 320 grams.

Similar tests were made using a urethane L.A.B. formulated according to U.S. Pat. No. 2,532,011 and a silicone L.A.B. but the percentage of solids had to be reduced significantly. When the paper stock was coated with urethane L.A.B. with 1% urethane solids to a wet thickness of 0.001 inch (0.025 mm) and the silicone L.A.B. was coated with 0.5% silicone solids to a wet thickness of 0.001 inch (0.025 mm), the initial adhesion strength with the urethane L.A.B. was 240 grams per 1.27 cm of tape width. The silicone L.A.B. had an initial adhesion strength of 200 grams per 1.27 cm of tape width. The silicone L.A.B. was "Syl-Off" 294 from Dow Chemical Company, Midland, Mich.

EXAMPLE 2

Jersey 80 pound embossed leatherette finish paper cover stock from James River Corporation had a strip of 2 mil (0.05 mm) thick polyester film (Minnesota Mining and Manufacturing Company, 3M OR 870197) applied along the fold line of the cover. The film was coated with an acrylic low adhesion backsize with 5% acrylate solids using a 0.001 inch (0.025 mm) orifice hand coater. The strip of polyester film was air dried and then tested with the half-inch Scotch brand binding tape No. C-7888. The initial peel adhesion strength was 165 grams of 1.27 cm width of tape, with an accelerated aging strength of 245 grams per 1.27 cm of tape width.

The use of the acrylic L.A.B. coating at 5% solids on the polyester failed to produce a useful protective coating for the paper cover stock. It would not be appropriate to have a cover for binding sheets if the sheets could fall from the cover under normal usage within minutes or days of the sheets being bound.

EXAMPLE 3

A Minnesota Mining and Manufacturing Company 0.001 inch (0.025 mm) polyester film designated as No. 860140 was applied to the James River, Jersey 80 pound embossed paper cover stock and tested with the Scotch brand binding tape No. C-7888. The initial peel adhesion strength of the binding was 400 grams and the strength after accelerated aging, as described above in Example 1, exceeded 1,040 grams, per 1.27 cm of tape width.

Polyester film which is uncoated and adhered in a cover may make a suitable binder but it lacks the reusable characteristic over a period of time. The initial binding strength is such that the cover would be reusable to adjust the position of the bound sheets in the cover but would not be a reusable cover after a period of time when the documents bound in the cover were to be removed.

EXAMPLE 4

A 0.06 mm thick polypropylene film, available from Toray, Inc. of Tokyo, Japan, was supported on a surface for the adhesion peel test. There was no treatment given or coating applied to the exposed surface of the film. The initial adhesion strength was 320 grams per 1.27 cm width of Scotch brand binding tape No. C-7888. Test results after accelerated aging were 440 grams.

Polypropylene as available from Toray, Inc. proved very suitable as a protective coating for the cover stock, and permitted the applying and removal of the binding tape without transfer of the adhesive from the binding tape to the film, without deleteriously effecting the paper stock of the cover, or breaking of the binding tape.

EXAMPLE 5

A 0.003 cm thick polypropylene film made by Minnesota Mining and Manufacturing Company was bound in the cover. The film was passed under a corona bar. The peel adhesion test showed an initial adhesion strength of 450 grams on one test, 430 grams on the second. The age test of 14 days at about 50° C., to simulate one year, provided a peel adhesion strength of 560 grams and 590 grams per 1.27 cm of tape width in two aging tests.

This polypropylene film also provided a satisfactory protective coating.

Another untreated film which suitably passed the test was cellophane purchased from E. I. du Pont de Nemours & Co., of Wilmington, Del., which was 0.0014 inch (0.036 mm) thick. This material had an initial adhesion strength of 330 grams per 1.27 cm of finding tape width and an accelerated aging adhesion of 570 grams.

Untreated polystyrene film purchased from Dow Chemical Company had an initial peel adhesion strength of 420 grams, and an accelerated aging strength of 530 grams per 1.27 cm of finding tape width.

Films of untreated polyvinyl chloride had an initial peel adhesion strength of 400 grams per 1.27 cm of finding tape width but the tape stuck to the surface and could not be removed after accelerated aging.

An untreated cellulose acetate film had an initial adhesion strength of 440 grams per 1.27 cm of finding tape width and an accelerated aging adhesion strength of 960 grams.

Unplasticized polyvinyl chloride film had an initial peel adhesion strength of 320 grams per 1.27 cm of finding tape width, but, after accelerated aging, stuck to the surface of the film and could not be removed.

The films can be adhered to the inside of the covers by a pressure-sensitive adhesive transfer tape such as Scotch brand No. 465 adhesive transfer tape available from Minnesota Mining and Manufacturing Company of St. Paul, Minn.

A cover which is suitable for use in tape binding sheets must have a peel adhesion strength of about 200 grams per 1.27 cm of binding tape width and not exceed about 700 grams per 1.27 cm of binding tape width. In this range, the bound sheets can be removed from the document without breaking the binding tape, and the sheets are secure enough in the covers to prevent the sheets, at least 25 bound pages of 20 pound bond paper per 1300 square feet ream size, from coming loose from the covers during storage in a file. Both the ease of removal and the secure binding of the sheets for storage are factors of commercial importance for the covers.

It is important that a protective coating be applied to a paper cover stock binder to prevent the paper stock from delaminating when removing the binding tape from the cover.

The paper surface treatment or special film applied to the paper must conform to the paper surface and the score lines. It must not substantially alter the opening or closing characteristic of the cover during binding of the sheets or in normal handling or filing. A coating causing embrittlement results in reduced flexibility of the cover stock during binding and subsequent handling and filing. The use of films or coating over 0.076 mm in caliper for the protective coating tend to reduce the flexibility and conformity of the covers for binding and subsequent handling for filing.

The use of polymeric films or a coating treatment in excess of 0.076 mm in caliper on the inner surfaces of the front and rear cover adjacent the fold line adds substantially to the thickness of the bound document and thus reduces its commercial suitability. The area within the cover that is treated is dependent on the width of the binding tape used, the number of pages being bound in the cover and the binding of multi-stacks of papers in one cover.

Figure 3:
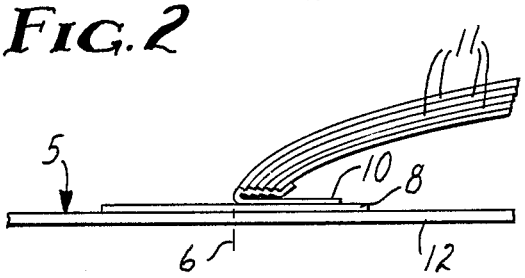
FIG. 3 is an enlarged diagrammatic view showing the cover of the present invention with a plurality of sheets bound together by a pressure-sensitive adhesive tape and adhered to the cover.

As shown in FIG. 3, the binding tape 10 is adhered along the shingled edge of each of the sheets 11 and is folded at an angle of substantially 180 degrees and has its adhesive coated surface applied to the protective coating 8 inside of the back cover 12 of the binder 5. When the cover is closed and the bound documents are in place in a file it is readily apparent that the binding tape is subjected to peeling forces which would tend to separate the bound documents from the cover.

Figure 4:
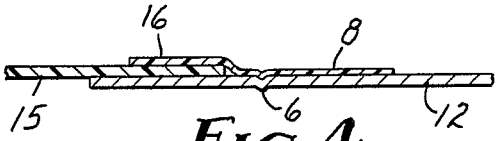
FIG. 4 is an enlarged fragmentary transverse sectional view of an embodiment of the cover having a transparent cover portion laminated to another material adjacent the fold line.
Figure 5:
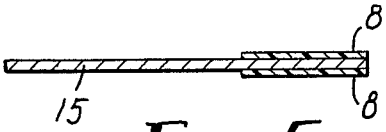
FIG. 5 is an enlarged transverse sectional view showing another embodiment of a cover.

In an alternative embodiment the front cover 15 or front face of the binding 5 could be formed of a transparent film which is laminated to a paper cover stock as at an area 16 extending along and adjacent the fold line 6 as shown in FIG. 4. In this embodiment the transparent cover portion 15 is laminated to the inside surface of the opaque cover sheet in the area 16 by a suitable laminating adhesive. The transparent cover avoids the need for a title or label to be applied to the outside face of the cover as the title page of the bound document can be seen readily through the transparent cover portion of the binder. A protective covering 8 is applied along the fold line 6 particularily on the inside surface of the rear cover portion 12.

The binder 5 may be formed of a polymeric film and not require a protective coating if the binder is formed of a polymeric material having an adhesive strength with respect to the binding tape of between 200 and 700 grams per 1.27 cm of binding tape width under a standard 180° peel adhesion test for pressure-sensitive adhesive tapes. An example of a suitable film of polymeric material is polypropylene with the sheet formed with score line 6 allowing the cover to close and open to a flat position.

It is further contemplated that two-piece covers may be used and bound with the sheets of the pamphlet or brochure. Such two-piece covers would have a protective coating on the outside marginal edge of the cover adjacent the spine. Such coating may be on both the inside and outside edge. Further, the one-piece covers could be perforated along the fold line to permit the user to separate the front and back portions. They can be turned inside out and then bound with the sheets with the opposite marginal edges of the binding tape being adhered to the protective coated edges on the exterior of the two cover sheets.

Having thus described the present invention with respect to a preferred embodiment, what is claimed is:

1. A cover adapted for covering and supporting paper sheets of known length and width bound together along shingled edges of the sheets by a length of the commercially available pressure sensitive adhesive coated "Scotch" brand binding tape No. C-7888, which binding tape has a portion extending beyond the edges of the bound sheets adapted to be adhered to the cover to form a booklet or brochure. said cover comprising:

a sheet of paper cover stock of a predetermined size for covering the bound sheets when folded generally centrally of said sheet along a fold line, and a continuous protective coating on said sheet along and adjacent both sides of said fold line for protecting said paper cover stock, said coating affording sufficient adhesion of the pressure-sensitive adhesive on said binding tape to said protective coating to hold sheets bound by said binding tape to said cover and affording release of said binding tape therefrom under peeling forces without deleterious effect to said coating, the paper cover stock or to the binding tape, which adhesion requires a removal peel force of between 200 and 700 grams per 1.27 cm of said binding tape width under standard peel adhesion test ASTM D 3330-81 for pressure sensitive adhesive tape.

2. A cover according to claim 1 wherein a protective coating of polypropylene is applied to said paper cover stock adjacent the fold line.

3. A cover according to claim 1 wherein said sheet of paper and the protective coating is perforated along the fold line.

4. A cover according to claim 1 wherein the protective coating is a length of film applied along the fold line.

5. A cover according to claim 4 wherein said film is one of polypropylene, polystyrene, and cellophane.

6. A cover according to claim 1 wherein the protective coating is a low adhesion backsize coating applied to the paper cover stock.

7. A cover according to claim 6 wherein said low adhesion backsize contains 5% acrylate solids in a wet coating thickness of 0.025 mm.

8. A cover according to claim 6 wherein said low adhesion backsize contains 1% urethane solids in a wet coating thickness of 0.025 mm.

9. A cover according to claim 6 wherein said low adhesion backsize contains 0.5% solicone solids in a wet coating thickness of 0.025 mm.

10. A cover adapted for covering and supporting paper sheets of known length and width bound together along shingled edges of the sheets by a length of the commercially available pressure sensitive adhesive coated "Scotch" brand binding tape No. C-7888, which binding tape has a portion extending beyond the edges of the bound sheets adapted to be adhered to the cover to form a booklet, said cover comprising:

a sheet of predetermined size for covering the sheets of bound paper and formed of opaque paper cover stock laminated along one edge to a piece of transparent film to form a front cover portion which is transparent and a rear cover portion of said opaque paper cover stock with a fold line in the paper cover stock generally centrally of the sheet, and a continuous protective coating along said fold line and on each side thereof to defined a coated surface affording sufficient adhesion of the pressure-sensitive adhesive on said binding tape to said coated surface to hold sheets bound by said binding tape to said cover and affording release of said binding tape therefrom under peeling forces not exceeding the strength of the tape, which adhesion requires a removal peel force of between 200 and 700 grams per 1.27 cm of binding tape width under standard peel adhesion test ASTM D 3330-81 for pressure sensitive adhesive tape.

11. A cover according to claim 10 wherein said protective coating comprises a length of film which film has a width to cover an area of the paper cover stock and an area of the transparent film, where it is laminated to the paper cover stock, on opposite sides of the fold line.

12. A cover sheet for use in covering and supporting a plurality of sheets bound together along shingled edges of the sheets by a length of the commercially available pressure sensitive adhesive coated "Scotch" brand binding tape No. C-7888, which binding tape has a portion extending beyond the edges of the bound sheets adapted to be adhered to the cover sheet to form a bound document, said cover sheet consisting essentially of a sheet of material having one edge to be positioned at the spine of the bound document, and a protective coating applied to said sheet of material along the margin at said edge, said protective coating providing a 180 peel adhesion for the pressure sensitive adhesive binding tape of between 200 and 700 grams per 1.27 cm of said binding tape width under standard peel adhesion test ASTM D 3330-81 for pressure sensitive adhesive tape.

13. A cover sheet according to claim 12 wherein said protective coating is on the marginal edge on both sides of the sheet at the edge of the sheet to be bound at the spine.

14. A booklet comprising a plurality of paper sheets of known length and width having parallel, adjacent shingled edges, a length of pressure sensitive adhesive coated binding tape having a first portion adhered over said shingled edges to bind together said sheets, and a second portion extending beyond the edges of the bound sheets, a sheet of paper cover stock of a predetermined size folded generally centrally of said sheet along a fold line and covering the bound sheets, and a continuous protective coating on said sheet along and adjacent both sides of said fold line for protecting said paper cover stock, the pressure sensitive adhesive on said second portion of said binding tape being adhered to said protective coating to hold said sheets bound by said binding tape to said cover while affording release of said binding tape therefrom under peeling forces without deleterious effect to said coating, the paper cover stock or to the binding tape, which adhesion requires a removal peel force of between 200 and 700 grams per 1.27 cm of said binding tape width under standard peel adhesion test ASTM D 3330-81 for pressure sensitive adhesive tape.

15. A booklet comprising a plurality of paper sheets of known length and width having parallel, adjacent shingled edges, a length of pressure sensitive adhesive coated binding tape having a first portion adhered over said shingled edges to bind together said sheets, and a second portion extending beyond the edges of the bound sheets, a sheet of predetermined size for covering the sheets of bound paper and formed of opaque paper cover stock laminated along one edge to a piece of transparent film to form a froont cover portion which is transparent and a rear cover portion of said opaque paper cover stock with a fold line in the paper cover stock generally centrally of the sheet, and a continuous protective coating along and adjacent both sides of said fold line with the pressure sensitive adhesive on said second portion of said binding tape being adhered to said protective coating to hold said sheets bound by said binding tape to said cover while affording release of said binding tape therefrom under peeling forces without deleterious effect to said coating or to the binding tape, which adhesion requires a removal peel force of between 200 and 700 grams per 1.27 cm of said binding tape width under standard peel adhesion test ASTM D 3330-81 for pressure sensitive adhesive tape.

* * * * *